US009580840B2

(12) United States Patent
Shimbara

(10) Patent No.: US 9,580,840 B2
(45) Date of Patent: Feb. 28, 2017

(54) COMBING CYLINDER FOR COMBER

(71) Applicant: KABUSHIKI KAISHA TOYOTA JIDOSHOKKI, Kariya-shi, Aichi-ken (JP)

(72) Inventor: Masami Shimbara, Kariya (JP)

(73) Assignee: KABUSHIKI KAISHA TOYOTA JIDOSHOKKI, Kariya-shi, Aichi-ken (JP)

( * ) Notice: Subject to any disclaimer, the term of this patent is extended or adjusted under 35 U.S.C. 154(b) by 231 days.

(21) Appl. No.: 14/560,590

(22) Filed: Dec. 4, 2014

(65) Prior Publication Data

US 2015/0167202 A1 Jun. 18, 2015

(30) Foreign Application Priority Data

Dec. 12, 2013 (JP) ..... 2013-257123

(51) Int. Cl.
*D01G 19/10* (2006.01)

(52) U.S. Cl.
CPC ..... *D01G 19/105* (2013.01)

(58) Field of Classification Search
CPC ..... D01G 19/105
See application file for complete search history.

(56) References Cited

U.S. PATENT DOCUMENTS 822,479 A * 6/1906 Rooney ..... D01G 19/28 19/115 B
1,493,201 A * 5/1924 Horridge ..... D01G 19/105 19/234
1,892,317 A * 12/1932 Nasmith ..... D01G 19/14 19/218
3,135,024 A * 6/1964 Nydam ..... D01G 19/105 19/234

(Continued)

FOREIGN PATENT DOCUMENTS

DE 10163663 A1 7/2003
JP 57-56524 A 4/1982

(Continued)

OTHER PUBLICATIONS

Communication dated Sep. 29, 2015 from the Japanese Patent Office issued in corresponding Japanese application No. 2013-257123.

*Primary Examiner* — Shaun R Hurley
(74) *Attorney, Agent, or Firm* — Sughrue Mion, PLLC

(57) ABSTRACT

A combing cylinder for a comber includes a cylinder shaft having threaded bores, and a base directly attached to the cylinder shaft. The base includes threaded bores formed in an inner surface of the base. The combing cylinder includes combing needles supported on an outer circumferential surface of the base and a balance weight directly attached to part of the cylinder shaft that is opposite from the part where the base is attached. The combing cylinder includes balance weight fixing bolts screwed to the threaded bores of the (Continued)

cylinder shaft to secure the balance weight to the cylinder shaft and base fixing bolts extending through the cylinder shaft and screwed to the threaded bores of the base to secure the base to the cylinder shaft. Each base fixing bolt includes a head, and the cylinder shaft includes in it a seat that receives the head.

6 Claims, 3 Drawing Sheets

(56) References Cited

U.S. PATENT DOCUMENTS

| | | | | | |
|---|---|---|---|---|---|
| 3,419,941 | A | * | 1/1969 | Moriwaki | D01G 19/105 19/234 |
| 3,585,706 | A | * | 6/1971 | Moriwaki | D01G 15/88 19/234 |
| 3,922,757 | A | * | 12/1975 | Horiuchi | D01G 19/105 19/234 |
| 4,394,789 | A | * | 7/1983 | Egerer | D01H 4/32 19/114 |
| 5,001,815 | A | * | 3/1991 | Kishi | D01G 19/105 19/223 |
| 5,109,574 | A | * | 5/1992 | Eichenberger | D01G 19/105 19/215 |

FOREIGN PATENT DOCUMENTS

| | | | |
|---|---|---|---|
| JP | 58-172474 | U | 11/1983 |
| JP | 2013-538946 | A | 10/2013 |
| WO | 2012/027852 | A1 | 3/2012 |

* cited by examiner

COMBING CYLINDER FOR COMBER

BACKGROUND OF THE INVENTION

The present invention relates to a combing cylinder for a comber.

The comber includes a working portion provided with multiple (typically, eight) combing heads. The combing heads perform a series of operation to form slivers from laps. Each combing head includes a pair of a lap roller and a feed roller that operates to feed a lap by a predetermined amount at a time. The leading end of the lap is clamped by a nipper including a bottom nipper and a top nipper. The combing cylinder combs the leading end of the lap to form a fleece, and the fleece is moved toward detaching rollers by forward movement of the nipper. The rotation of the detaching rollers is reversed in accordance with the forward movement of the fleece to move the previously received fleece (preceding fleece) backward so that the trailing end of the fleece overlap the leading end of a newly combed fleece (following fleece). Subsequently, the detaching rollers rotate forward to receive the fleece from the nipper, and the top comb penetrates into the fleece to comb the trailing end of the fleece. The fleeces formed by the combing heads through repeating these operations are bundled and drafted, and then compressed by calender rollers to manufacture a sliver.

FIG. 6 shows a combing cylinder 50 disclosed in Japanese Laid-Open Utility Model Publication No. 58-172474. The combing cylinder 50 includes a pair of mounting bosses 52 (only one of the mounting bosses 52 is shown in FIG. 6) fitted to a cylinder shaft 51 of a comber to be arranged apart from each other in the axial direction at a predetermined interval. On the outer circumference of the mounting bosses 52 are provided a combing segment 53 having an arcuate cross-section and a balance weight 54. The combing segment 53 is secured with bolts 55, and the balance weight 54 is secured with bolts 56. Each mounting boss 52 has an integrally formed inner ring 57 on its inner end. The inner ring 57 has a slit 57*a*. On the outer end of the inner ring 57 is fitted an outer ring 59 with a setscrew 58 screwed to extend perpendicularly to the slit 57*a*. Screwing the setscrew 58 causes the inner ring 57 to tighten the cylinder shaft 51, and thus the combing cylinder 50 is secured to the cylinder shaft 51.

FIGS. 7 and 8 show a combing cylinder 60 that has been proposed in Japanese National Phase Laid-Open Patent Publication 2013-538946. The combing cylinder 60 includes a base 62 and a balance weight 63 directly attached to a cylinder shaft 64. The base 62 has an outer circumferential surface that supports a card clothing 61.

The balance weight 63 is secured to the cylinder shaft 64 with multiple bolts 65, which extend through the balance weight 63 and are screwed to threaded bores formed in the cylinder shaft 64. The base 62 is secured to the cylinder shaft 64 with multiple bolts 66, which extend through the balance weight 63 and the cylinder shaft 64 and are screwed to threaded bores formed in the base 62. A cover 67 is attached to each end face of the base 62 with screws 68. The covers 67 block hollow spaces 62*a* of the base 62 from the outside.

In accordance with the kind of cotton and the required sliver quality, a comb (a combing segment or a card clothing) used is selected from a group of combs having different needle arrays (teeth). The number and the shape of comb needles vary depending on the kind of the comb, and the balance rate and the shape required for the balance weight vary in accordance with the kind of the comb. Ideally, the balance weight with the optimum balance rate and shape is selected in accordance with the kind of the comb. In reality, difference in the required balance rate and shape has been ignored, and one kind of balance weight has been used. The difference in the balance rate and the shape, however, can no longer be ignored because vibration of the comber has increased due to recent speed increase of the comber.

Combing cylinders have also been proposed that include multiple elements detachably secured to a base. Each element includes a needle array (teeth) that range in the size. Such a combing cylinder allows any of the elements to be replaced without detaching the base from the cylinder shaft. The balance weight, however, needs to be replaced when replacing the element because the balance will be lost by replacing the element.

The combing cylinder 50 of Japanese Laid-Open Utility Model Publication No. 58-172474 allows the balance weight 54 to be detached from the cylinder shaft 51 without detaching the combing segment 53 from the cylinder shaft 51. In combers, it is important to minimize the distance between the outer circumference of the combing segment 53, or the distal end of the needles, and the axis of the cylinder shaft 51. Furthermore, the combing cylinder 50 is driven at variable speeds and should have small inertia. The combing cylinder 50 of Japanese Laid-Open Utility Model Publication No. 58-172474, however, includes the mounting bosses 52 between the combing segment 53 and the cylinder shaft 51. Thus, when the distance between the axis of the cylinder shaft 51 and the outer circumference of the combing segment 53 is set to a predetermined value, an error in the distance is increased. Moreover, the inertia of the combing cylinder 50 is increased.

The combing cylinder 60 disclosed in Japanese National Phase Laid-Open Patent Publication 2013-538946 includes the base 62 directly secured to the cylinder shaft 64. As compared to the combing cylinder 50 of Japanese Laid-Open Utility Model Publication No. 58-172474, the error in the distance between the cylinder shaft 64 and the outer circumference of the card clothing 61 is reduced, and the inertia is also reduced. The combing cylinder 60 of Japanese National Phase Laid-Open Patent Publication 2013-538946, however, requires the comb main body, or the base 62, to be removed from the cylinder shaft 64 to detach the balance weight 63 from the cylinder shaft 64. Thus, detaching the balance weight 63 is complicated and involves a risk of damaging the comb needles, which are critical components.

SUMMARY OF THE INVENTION

Accordingly, it is an objective of the present invention to provide a combing cylinder for a comber that includes a base and a balance weight attached to a cylinder shaft to contact the cylinder shaft and that allows the balance weight to be independently replaced without detaching the base from the cylinder shaft.

To achieve the foregoing objective and in accordance with one aspect of the present invention, a combing cylinder for a comber is provided that includes a cylinder shaft having an outer circumferential surface and a threaded bore, a base, a combing needles, a balance weight, a balance weight fixing bolt, and a base fixing bolt. The base is directly attached to the cylinder shaft and includes an outer circumferential surface, an inner surface contacting the outer circumferential surface of the cylinder shaft, and a threaded bore formed in the inner surface. The combing needles are supported on the outer circumferential surface of the base. The balance weight is directly attached to part of the cylinder shaft that is opposite from the part where the base is attached. The balance weight fixing bolt is screwed to the threaded bore of the cylinder shaft to secure the balance weight to the cylinder shaft. The base fixing bolt extends through the cylinder shaft and is screwed to the threaded bore of the base to secure the base to the cylinder shaft. The base fixing bolt includes a head. The cylinder shaft includes in it a seat that receives the head.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A first embodiment of the present invention will now be described with reference to FIGS. 1 to 3.

A combing cylinder 11 of a comber is directly mounted on a cylinder shaft 12. The combing cylinder 11 includes a base 14 and a balance weight 15. The base 14 has an outer circumferential surface 14*d* that supports combing needles (card clothing) 13. The balance weight 15 is directly mounted on the cylinder shaft 12 at a position opposite from the base 14.

Figure 2:
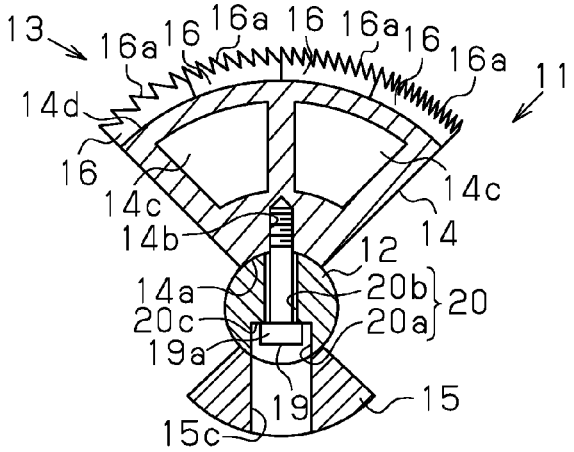
FIG. 2 is a cross-sectional view illustrating the combing cylinder of FIG. 1, cut at a position corresponding to one of the base fixing bolts.
Figure 3:
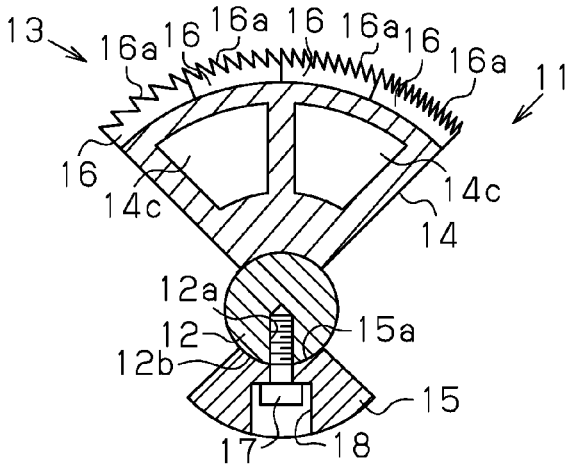
FIG. 3 is a cross-sectional view illustrating the combing cylinder of FIG. 1, cut at a position corresponding to one of the balance weight fixing bolts.

As shown in FIGS. 2 and 3, multiple (in the present embodiment, four) elements 16 forming the combing needles 13 are detachably secured to the base 14. The elements 16 include needle arrays (teeth) 16*a* that range in the size. The elements 16 employ a known structure and are attachable to and detachable from the base 14 without detaching the base 14 from the cylinder shaft 12.

The balance weight 15 has a substantially sectorial cross section. The balance weight 15 is secured to the cylinder shaft 12 using balance weight fixing bolts 17 with an inner surface 15*a* of the balance weight 15 abutting against an outer circumferential surface 12*b* of the cylinder shaft 12. The balance weight 15 has bolt holes 18 each having a step, and the cylinder shaft 12 has threaded bores 12*a* at positions corresponding to the bolt holes 18. Each balance weight fixing bolt 17 includes a shank that extends through the associated bolt hole 18 to be screwed to the associated threaded bore 12*a* and a head that abuts against the step of the bolt hole 18. The balance weight fixing bolts 17 secure the balance weight 15 to the cylinder shaft 12. That is, the balance weight 15 is secured to the cylinder shaft 12 with the balance weight fixing bolts 17 screwed to the threaded bores 12*a* formed in the cylinder shaft 12.

Figure 1:
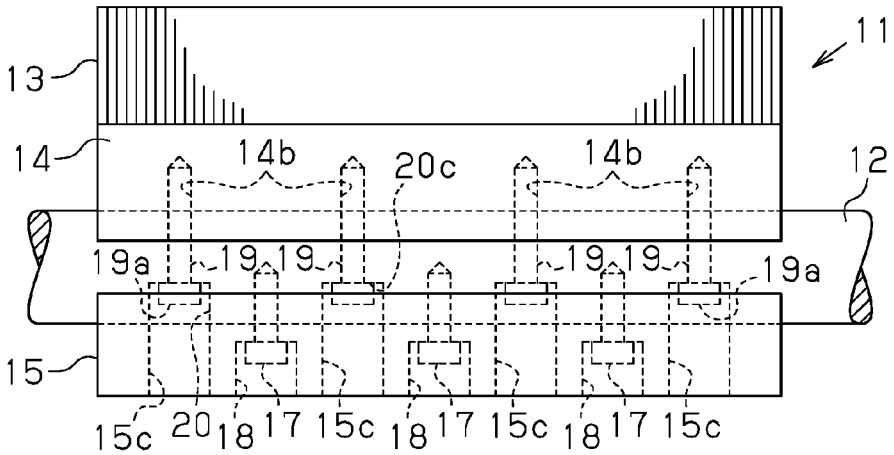
FIG. 1 is a front view illustrating a combing cylinder according to a first embodiment.

As shown in FIGS. 1 and 2, the base 14 has a substantially sectorial cross-section. The base 14 includes an inner surface, which is an arcuate surface 14*a* in this embodiment. The arcuate surface 14*a* abuts against the outer circumferential surface 12*b* of the cylinder shaft 12. The base 14 is secured to the cylinder shaft 12 with base fixing bolts 19 in a state where the base 14 is opposed to the balance weight 15 with the cylinder shaft 12 located in between. The balance weight 15 has through holes 15*c* each permitting a head 19*a* of the associated base fixing bolt 19 to pass through, and the cylinder shaft 12 has bolt holes 20 for the base fixing bolts 19 at positions corresponding to the through holes 15*c*. Each bolt hole 20 includes a recess 20*a* for accommodating the head 19*a* of the associated base fixing bolt 19 and a through hole 20*b* that is continuous with the recess 20*a* and permits the shank of the base fixing bolt 19 to pass through. The recess 20*a* has a larger diameter than the through hole 20*b*. The bottom surface of the recess 20*a*, in other words, the step between the recess 20*a* and the through hole 20*b* configures a seat 20*c* that the head 19*a* of the base fixing bolt 19 contacts. That is, the seat 20*c*, with which the head 19*a* of the base fixing bolt 19 is in contact, or in other words, the seat 20*c*, which receives the head 19*a*, is located in the cylinder shaft 12. The head 19*a* of the base fixing bolt 19 includes a first surface contacting the seat 20*c* and a second surface opposite from the first surface, and the second surface is located in the recess 20*a*.

The arcuate surface 14*a* of the base 14 has threaded bores 14*b* formed at positions corresponding to the bolt holes 20. The shank of each base fixing bolt 19 is inserted through the associated bolt hole 20 and is screwed to the associated threaded bore 14*b*, and the head 19*a* abuts against the seat 20*c* of the bolt hole 20. This secures the base 14 to the cylinder shaft 12. The base 14 includes hollow portions 14*c*. Non-illustrated covers that block the hollow portions 14*c* from the outside are secured to the axial end faces of the base 14.

Operation of the combing cylinder 11 formed as described above will now be described.

Figure 6:
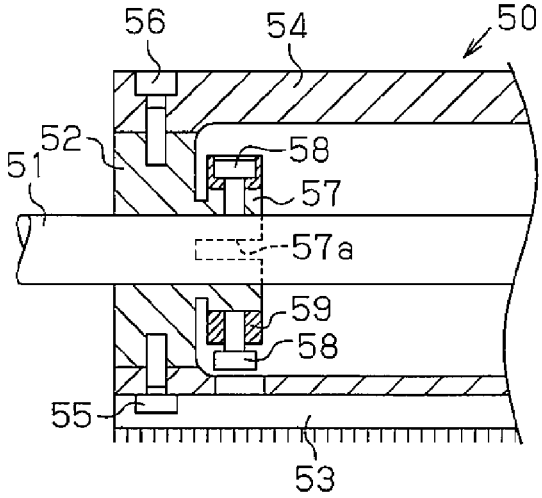
Fig.6(Prior Art)
FIG. 6 is a partial cross-sectional view illustrating a conventional combing cylinder.
Figure 7:
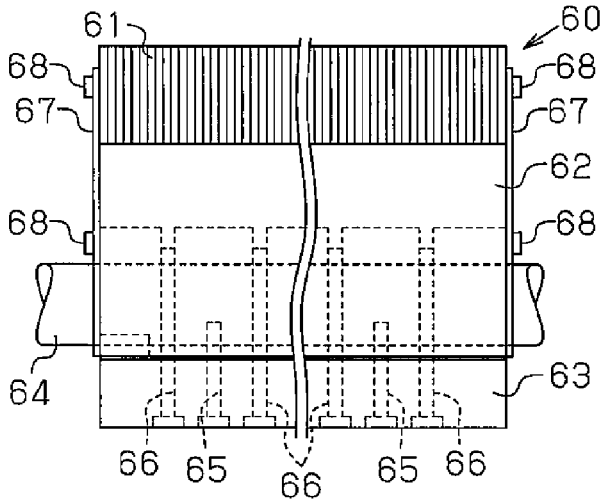
Fig.7(Prior Art)
FIG. 7 is a front view illustrating another conventional combing cylinder.
Figure 8:
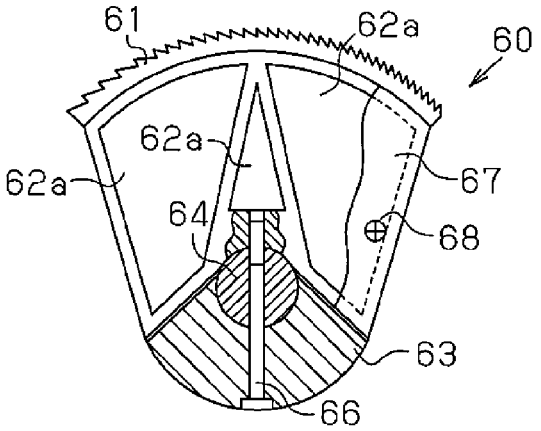
Fig.8(Prior Art)
FIG. 8 is a partial side view, with a part cut away, illustrating the combing cylinder of FIG. 7.

The base 14, which supports the combing needles 13, and the balance weight 15 are directly attached to the cylinder shaft 12. As compared to the structure of a combing cylinder 50 according to Japanese Laid-Open Utility Model Publication No. 58-172474 shown in FIG. 6, in which a combing segment 53 is attached to a cylinder shaft 51 via mounting bosses 52, an error in the distance between the axis of the cylinder shaft 12 and the distal end of the needles of the needle arrays 16*a* is reduced. Furthermore, the inertia of the combing cylinder 11 is also reduced. The combing cylinder 11 is therefore easily driven at variable speeds.

The comber combs in an appropriate manner corresponding to the spinning condition by using combing needles 13, that is, elements 16 selected from different combing needles 13 and elements 16 in accordance with the kind of cotton and the required sliver quality. Replacement of any of the elements 16 is performed with the base 14 secured to the cylinder shaft 12. If the balance weight 15 needs to be replaced due to the replacement of the element 16, the balance weight fixing bolts 17 are removed from the threaded bores 12*a* of the cylinder shaft 12, and the balance weight 15 is detached from the cylinder shaft 12. An appropriate balance weight 15 is secured to the cylinder shaft 12 with the balance weight fixing bolts 17. That is, the balance weight 15 is replaced without detaching the base 14.

Depending on the kind of cotton and the required sliver quality, instead of four kinds of needle arrays 16*a*, five or more kinds of needle arrays 16*a* may be necessary as the combing needles 13. In this case, the base 14 and the balance weight 15 both need to be replaced. To replace the base 14, the base fixing bolts 19 are removed from the threaded bores 14*b* of the base 14, and the base 14 is detached from the cylinder shaft 12. An appropriate base 14 is secured to the cylinder shaft 12 with the base fixing bolts 19. That is, the base 14 is replaced without detaching the balance weight 15.

The first embodiment has the following advantages.

(1) The combing cylinder 11 is directly attached to the cylinder shaft 12. The combing cylinder 11 includes the base 14, which has the outer circumferential surface 14*d* supporting the combing needles 13, and the balance weight 15, which is directly attached to the cylinder shaft 12 and located at the position opposite from the base 14. The balance weight 15 is secured to the cylinder shaft 12 with the balance weight fixing bolts 17, which are screwed to the threaded bores 12*a* formed in the cylinder shaft 12. The base 14 includes the arcuate surface 14*a* (inner surface), which abuts against the outer circumferential surface 12*b* of the cylinder shaft 12, and the arcuate surface 14*a* has the threaded bores 14*b*. The base 14 is opposed to the balance weight 15 with the cylinder shaft 12 located in between. In this state, the base 14 is secured to the cylinder shaft 12 with the base fixing bolts 19, which extend through the cylinder shaft 12 and are screwed to the threaded bores 14*b*. The seat 20*c*, which receives the head 19*a* of each base fixing bolt 19, is located in the cylinder shaft 12.

This structure allows the balance weight 15 to be independently replaced without detaching the base 14 from the cylinder shaft 12. This improves the workability in replacing the balance weight 15 and avoids a risk of damaging the combing needles 13.

(2) The combing needles 13 include the multiple elements 16 detachably secured to the base 14. The elements 16 include the needle arrays (teeth) 16*a* that range in the size. Thus, if the number of the needle arrays 16*a* does not need to be changed in the operation in which combing needles 13 are selected from different combing needles 13 in accordance with the kind of cotton and the sliver required quality, the operator only needs to replace one or some of the elements 16 and the balance weight 15.

The present embodiment is not limited to the above configuration, but may be modified as follows.

Figure 4:
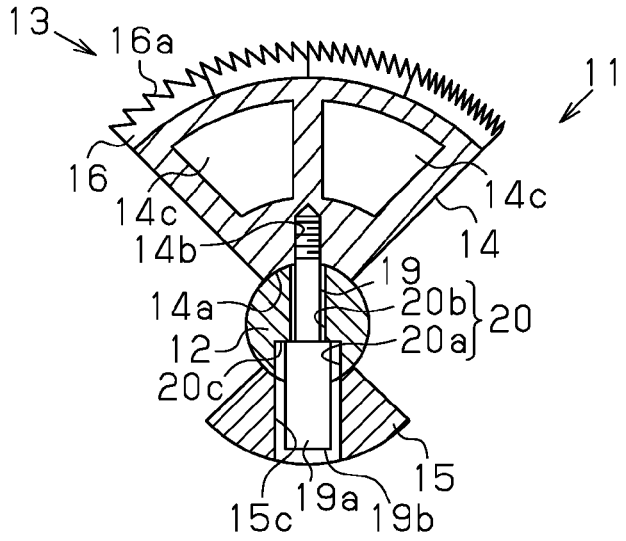
FIG. 4 is a cross-sectional view illustrating a combing cylinder according to a second embodiment.

Like a second embodiment shown in FIG. 4, the head 19*a* of each base fixing bolt 19 may be elongated such that a second surface 19*b* located opposite from the first surface, which contacts the seat 20*c*, is placed in the through hole 15*c* of the balance weight 15. That is, the head 19*a* extends from the recess 20*a* of the cylinder shaft 12 to the through hole 15*c* of the balance weight 15. This structure allows the head 19*a* of each base fixing bolt 19 to play part of the role of the balance weight 15. The thickness of the balance weight 15 may therefore be reduced in accordance with the role of the balance weight 15 played by the heads 19*a*. This reduces the inertia of the combing cylinder 11.

Figure 5:
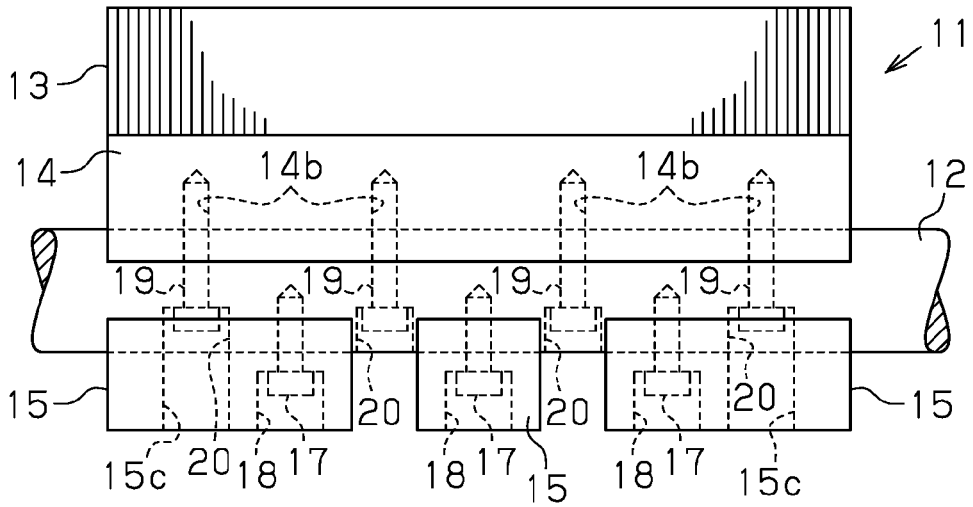
FIG. 5 is a front view illustrating a combing cylinder according to a third embodiment.

Like a third embodiment shown in FIG. 5, the balance weight 15 may be divided into multiple parts at positions corresponding to some of the base fixing bolts 19, and the some of the base fixing bolts 19 may be arranged between the divided balance weights 15.

In the third embodiment of FIG. 5, the balance weight 15 is divided at positions corresponding to some of the base fixing bolts 19. However, depending on the number of the balance weight fixing bolts 17 and the base fixing bolts 19, the balance weight 15 may be divided at positions corresponding to all the base fixing bolts 19, and all the base fixing bolts 19 may be located between the divided balance weights 15.

The number of the elements 16 including the needle arrays (teeth) 16*a* of different sizes is not limited to four, but may be, for example, five or more.

Instead of the elements 16 including the needle arrays (teeth) 16*a* of different sizes, a single card clothing that has different sizes of needle arrays may be secured to the base 14. In this case, multiple bases 14 each including a card clothing that corresponds to a different spinning condition are prepared. When the spinning condition is changed, the base fixing bolts 19 are loosened to replace the base 14, and the balance weight fixing bolts 17 are loosened to replace the balance weight 15 as required.

The inner surface of the base 14 may have any shape other than an arcuate surface such as a rectangular surface.

Therefore, the present examples and embodiments are to be considered as illustrative and not restrictive and the invention is not to be limited to the details given herein, but may be modified within the scope and equivalence of the appended claims.

The invention claimed is:

1. A combing cylinder for a comber, comprising:

a cylinder shaft having an outer circumferential surface and a threaded bore;

a base directly attached to the cylinder shaft, the base including an outer circumferential surface, an inner surface contacting the outer circumferential surface of the cylinder shaft, and a threaded bore formed in the inner surface;

combing needles supported on the outer circumferential surface of the base;

a balance weight directly attached to part of the cylinder shaft that is opposite from the part where the base is attached;

a balance weight fixing bolt screwed to the threaded bore of the cylinder shaft to secure the balance weight to the cylinder shaft; and a base fixing bolt that extends through the cylinder shaft and is screwed to the threaded bore of the base to secure the base to the cylinder shaft, wherein the base fixing bolt includes a head, and the cylinder shaft includes in it a seat that receives the head.

2. The combing cylinder according to claim 1, wherein the cylinder shaft includes a through hole, through which the base fixing bolt extends, and a recess that is continuous with the through hole and has a larger diameter than the through hole, and the through hole and the recess form a step that configures the seat.

3. The combing cylinder according to claim 2, wherein the balance weight includes a through hole that is continuous with the recess.

4. The combing cylinder according to claim 2, wherein the head of the base fixing bolt includes a first surface that contacts the seat and a second surface opposite from the first surface, and the second surface is located in the recess.

5. The combing cylinder according to claim 3, wherein the head of the base fixing bolt includes a first surface that contacts the seat and a second surface opposite from the first surface, and the head extends from the recess and along the through hole of the balance weight such that the second surface is located in the through hole of the balance weight.

6. The combing cylinder according to claim 1, wherein the balance weight includes a through hole, the head of the base fixing bolt includes a first surface that contacts the seat and a second surface opposite from the first surface, and the second surface is located in the through hole of the balance weight.

* * * * *